US006457516B2

(12) United States Patent
Brand et al.

(10) Patent No.: US 6,457,516 B2
(45) Date of Patent: Oct. 1, 2002

(54) HEAT TRANSFER TUBE FOR EVAPORATION WITH VARIABLE PORE SIZES

(75) Inventors: Karine Brand, Bryan, TX (US); Andreas Beutler, Weissenhorn (DE); Manfred Knab, Dornstadt (DE); Gerhard Schuez, Voehringen (DE); Andreas Schwitalla, Illerrieden (DE)

(73) Assignee: Wieland-Werke AG, Ulm (DE)

( * ) Notice: Subject to any disclaimer, the term of this patent is extended or adjusted under 35 U.S.C. 154(b) by 0 days.

(21) Appl. No.: 09/859,789

(22) Filed: May 17, 2001

(30) Foreign Application Priority Data

May 18, 2000 (DE) ..... 100 24 682

(51) Int. Cl.[7] ..... F28F 13/18

(52) U.S. Cl. ..... 165/133; 165/179; 165/184; 29/890.053

(58) Field of Search ..... 165/133, 179, 165/184, DIG. 516, DIG. 520; 29/890.053, 890.049

(56) References Cited

U.S. PATENT DOCUMENTS

| | | | | | |
|---|---|---|---|---|---|
| 4,179,911 | A | * | 12/1979 | Saier et al. | 165/184 |
| 4,313,248 | A | * | 2/1982 | Fujikake | 165/133 |
| 4,653,163 | A | * | 3/1987 | Kuwahara et al. | 165/133 |
| 5,203,404 | A | * | 4/1993 | Chiang et al. | 165/133 |
| 5,775,411 | A | * | 7/1998 | Schuez et al. | 165/133 |
| 5,803,164 | A | * | 9/1998 | Schuez et al. | 165/184 |

* cited by examiner

*Primary Examiner*—Henry Bennett
*Assistant Examiner*—Terrell McKinnon
(74) *Attorney, Agent, or Firm*—Flynn, Thiel, Boutelle Tanis, P.C.

(57) ABSTRACT

The invention relates to a heat-transfer tube, in particular an evaporator tube, with fins circumferentially extending on the shellside, which fins are shaped to essentially closed-off channels. The channels are open to the outside through pores with at least two variable sizes. In order to improve the evaporation characteristics, the invention provides advantageous regions for the ratio of the pore sizes and the ratio of the number of pores.

13 Claims, 6 Drawing Sheets

HEAT TRANSFER TUBE FOR EVAPORATION WITH VARIABLE PORE SIZES

FIELD OF THE INVENTION

The invention relates to a metallic heat transfer tube, in particular for the evaporation of liquids from pure substances or mixtures oriented on the outside of the tube.

BACKGROUND OF THE INVENTION

In the following discussion, certain specific terminology will be used. The phrase "shellside" is to refer to the outside region of a tube. The phrase "tubeside" is to refer to the inside region of a tube.

Evaporation occurs in many fields of air-conditioning and refrigeration engineering and process and energy engineering. In engineering often so-called shell and tube heat exchangers are utilized in which liquids from pure substances or mixtures evaporate on the shellside and thereby cool off a brine or water on the tubeside. Such apparatus are identified as flooded evaporators.

By intensifying the heat transfer on the shellside and the tubeside, it is possible to significantly reduce the size of the evaporator. This reduces the manufacturing costs of such apparatus. Furthermore, the necessary filling capacity of refrigerant is reduced, which refrigerant, in view of the present day predominant use of HFCs, adds up to a significant portion of the costs of the entire system. In the case of toxic or combustible refrigerants, it is furthermore possible to reduce the potential of danger by reducing the filling capacity. The double enhanced tubes, which are common today, are more efficient approximately by a factor three then plain or smooth tubes with the same diameter.

The present invention relates to structured tubes, in which the shellside heat transfer coefficient is intensified. Since through this the main portion of the heat transfer resistance is often shifted to the inside of the tube, it is as a rule also necessary to intensify the heat transfer coefficient on the inside. Heat transfer tubes for shell and tube heat exchangers have usually at least one structured area and smooth ends and possibly smooth center lands. The smooth ends or smooth center lands confine the structured areas. In order for the tube to be able to be installed without any problems into the shell and tube heat exchanger, the outside diameter of the structured areas may not be greater than the outside diameter of the smooth ends and smooth center lands.

To increase heat transfer during evaporation, the process of the nucleate boiling is intensified. It is known that the formation of bubbles starts at the nucleation sites. These nucleation sites are mostly small gas or vapor inclusions. Such nucleation sites can be created merely by roughening the surface. When the increasing bubble has reached a specific size, it detaches from the surface. When during the course of the detachment of the bubble the nucleation site is flooded by the following flow of liquid, the gas or vapor inclusion is possibly displaced by liquid. The nucleation site is in this case inactivated. This can be avoided by suitably designing the nucleation sites. It is necessary for this purpose that the opening of the nucleation site is smaller than the cavity therebelow, as for example in re-entrant cavities.

It is state of the art to manufacture such cavities on the basis of integrally finned tubes. Integrally finned tubes are finned tubes in which the fins are formed out of the wall material of a plain or smooth tube. Various methods are known whereby the channels between adjacent fins are closed off in such a manner that connections between channel and surrounding area remain in form of pores or slots. Liquid and vapor can be transported through these pores or slots. Such essentially closed channels are created in particular by bending or folding of the fin (U.S. Pat. No. 3,696,861, U.S. Pat. No. 5,054,548), by splitting and flattening of the fin (DE 2,758,526, U.S. Pat. No. 4,577,381), and by notching and flattening of the fin (U.S. Pat. No. 4,660,630, EP 0,713,072, U.S. Pat. No. 4,216,826).

The known patents have the goal to produce an as much as possible constant channel and pore size. The U.S. Pat. No. 5,054,548 discloses depending on the substance to be evaporated (high pressure or low pressure refrigerant) optimal pore sizes of different sizes. This consideration assumes that the pore system is best constructed of equally large pores.

JP OS 63-172,892 describes a method with which large and small cavities are created that are closed off from one another. This is accomplished by widening the rolled fin channels at regular intervals. The individual cavities are connected to the outside area by variably large pores; however, large and small cavities are separated from one another. The goal of the JP OS 63-172,892 is to create a structure which is supposed to function steadily during variable heat fluxes, expressed by the wall superheat. The large cavities and pores are, during high wall superheat, suppose to assure the heat transfer, whereas the small cavities and channels separated therefrom are suppose to assure heat transfer during low wall superheat. This manner of consideration assumes again that a certain pore size is optimal for a specified operating condition (heat flux, equilibrium conditions, evaporating substance). The widening of the channels is achieved by a gearlike disk which is thicker than the channel width between the fins. With this the fins are pressed further apart to both sides at the widening area. The two adjacent channels are subsequently closed off at this area, thus creating individual cavities separated from one another. A comparatively very large opening is created at the widening area.

JP OS 54-16,766 suggests a heat transfer surface with large and small pore openings, whereby the pores are arranged in such a manner that all large pores are on one side of the tube and all small pores on the other side of the tube. Such a tube is provided for the horizontal installation into a shell and tube heat exchanger. However, the installation must be done in such a manner that the large pores are directed upwardly and the small pores downwardly. The liquid is then sucked in through the small pores and the vapor is ejected upwardly through the large pores. Such an installation in a specified orientation can, however, not be carried out during a large scale production of heat exchangers since the tubes are usually connected to the heat exchanger through a rolling operation, and during this rolling operation the tube rotates about its axis at an uncontrollable angle measurement. Furthermore it must be considered that in the case of this tube design the channels must have a very large volume for fluid hydraulic reasons. This results in disadvantageously high tube weights and in a large layer thickness of the outside structure. The latter results in a small inner cross-sectional surface of the tube and thus in an undesired high pressure drop of the fluid flowing in the tube.

U.S. Pat. No. 5,597,039 (or U.S. Pat No. 5,896,660) describes an evaporator tube with bent fin tips, whereby the fin tips are provided with notches prior to bending. Adjacent notches of one fin have hereby a different shape and/or size so that a system of different pore openings is created. It is thereby viewed as being significant that directly adjacent openings differ in size. Depending on the operating condition, expressed by the heat flux, the type of pores favorable for the operating condition is activated. The many different pores have the purpose of lending the tube good evaporation characteristics over a wide range of operating conditions. However, the respectively not active pores do not contribute to the evaporation process. Rather they reduce the density of the active nucleation sites and can thus even worsen the heat transfer characteristics of the tube.

SUMMARY OF THE INVENTION

The basic purpose of the invention is to produce a heat transfer tube of the mentioned type with improved characteristics regarding the heat transfer during evaporation of substances on the shellside. The heat transfer characteristics are adaptable to the properties of the substance to be evaporated and to the operating condition.

The purpose is attained according to the invention by the channels extending circumferentially with an essentially constant cross section between the fins being open outwardly through pores with at least two variable sizes, whereby both the ratio of the pore sizes and also the ratio of the number of small and large pores must meet specific conditions.

The size of one individual pore can be precisely defined and can be detected via a measuring technique. Based on the manufacturing process and caused by tolerances in material and tool, two at random selected pores have practically never the same shape and size. The pore size is subjected to statistical fluctuations. It therefore is advisable to divide the pores corresponding to their size into size classes, whereby the pores are grouped with a finite distribution width around maximums of frequency. Pores of variable sizes in the sense of the invention exist when in the histogram according to FIG. 5 the x-coordinates of adjacent maximums of the frequency distribution differ by at least 50% of the x-coordinate belonging to the smallest pore class.

For the determination of pore size and pore frequency distribution via a measuring technique, for example, a suitable image processing system, consisting of an optical scanning unit and digital data processing unit is utilized. The tube surface is detected through photography and the image is sorted in grey tones. By suitably choosing a grey tone threshold, the image of the tube surface is separated into pore areas and areas of a metallic surface. The pore areas are then geometrically measured and digitally evaluated. FIG. 5 illustrates the frequency distribution of the pore size, which frequency distribution has been determined by means of such a system on an inventive tube sample (compare the numerical example, which is dealt with later on). The pore size is characterized by the area of the pore opening, measured in $\mu m^2$. One recognizes two maximums in the histogram. The class of the small pores is grouped around the maximum with a pore area $A_s$, the class of the large pores is grouped around the maximum with a pore area $A_l$. The values $A_1$ and $A_s$ can thus be interpreted in each case as the average pore size of the two pore classes. The ratio $N_s/N_l$ (number $N_s$ of the small pores compared to the number $N_l$ of the large pores) is identified with m.

The channels between the fins are according to the invention essentially closed off by material of the upper fin regions, whereby the cavities created in this manner are connected by pores to the surrounding area. These pores are designed such that they can be divided into typically two classes. After a regular, repetitive pattern one or several large pores follow along the channels after each one specific number of small pores. An oriented flow in the channels is created by this structure. Liquid is pulled in through the small pores with the support of the capillary pressure and wets the channel walls, thus creating thin films. The liquid evaporates from the thin films. The vapor accumulates in the center of the channel and escapes at the areas with the least capillary pressure. These are the large pores arranged at specific intervals. The size ratio $A_l/A_s$ and frequency ratio m of the small and large pores are chosen in such a manner that the vapor can escape without too much liquid penetrating into the channels and floods same, which would destroy the very effective thin film evaporation. On the other hand, the vapor pores must be chosen sufficiently large so that the vapor does not accumulate back in the pores. Preferably the size ratio $A_l/A_s$=1.5 to 4, and more preferably $A_l/A_s$=2 to 3.

The following ratio between the entire opening area $F_s$ of all small pores and the entire opening area $F_l$ of all large pores is valid:

$$\frac{F_s}{F_l} := \frac{\sum_i A_{s,i}}{\sum_j A_{l,j}} = \frac{A_s \cdot N_s}{A_l \cdot N_l} = \frac{A_s}{A_l} \cdot m$$

The ratio of the entire opening areas must be adjusted to the properties of the substance which is being used. It must hereby be particularly considered when designing the pore geometry that this ratio should be proportional with respect to the square root of the density ratio of vapor $\rho_v$ and liquid $\rho_L$:

$$\frac{F_s}{F_l} \sim \sqrt{\frac{\rho_V}{\rho_L}}$$

Thus the pore structure can be adapted to the properties of the substance being used and the operating condition, in particular the pressure level.

Subject matter of the invention also includes a method for the manufacture of the inventive heat transfer tube.

Starting out from the method according to U.S. Pat. No. 5,896,660, the method of the invention is characterized by the notching being created by large and small teeth arranged on the circumference of the notching disk; the notched fin tips are flattened by radial pressure to the level of the notching.

An apparatus for carrying out the method of the invention is characterized by the notching disk having small and large teeth at regular intervals over its circumference, whereby in each case a specific number of small teeth is followed by a large tooth or several large teeth, and whereby the ratio m between the number of small teeth and the number of large teeth is 12:1 to 1:5, more preferably 9:1 to 1:3; and a flattening disk follows the notching disk. (This ratio m is naturally identical with $m=N_s/N_l$, which is the frequency ratio of small and large pores.)

BRIEF DESCRIPTION OF THE DRAWINGS

The invention will be described in greater detail with reference to the following exemplary embodiments, in which.

DETAILED DESCRIPTION

Figure 1:
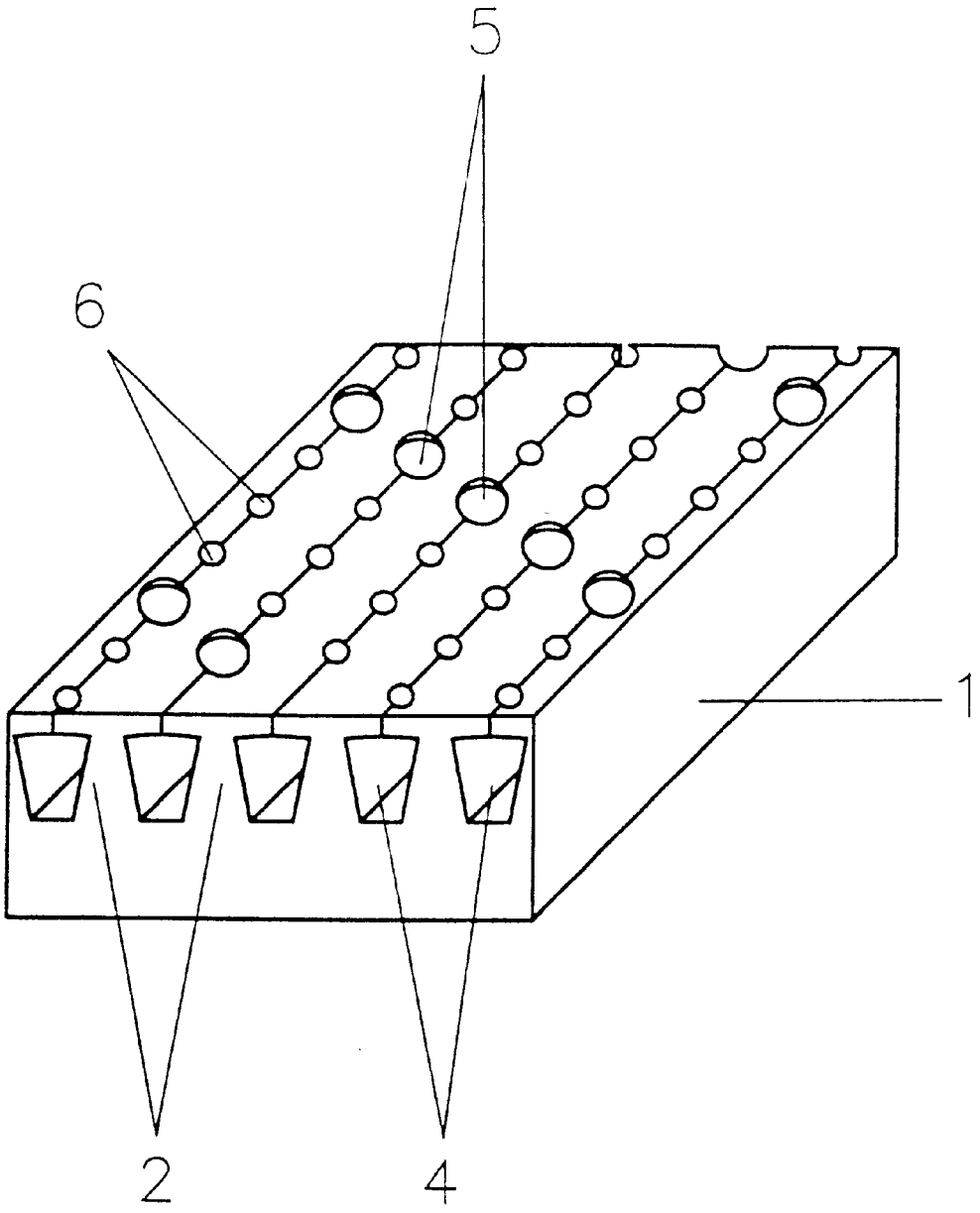
FIG. 1 schematically illustrates the surface of an inventive heat transfer tube having two classes of pores.
Figure 2:
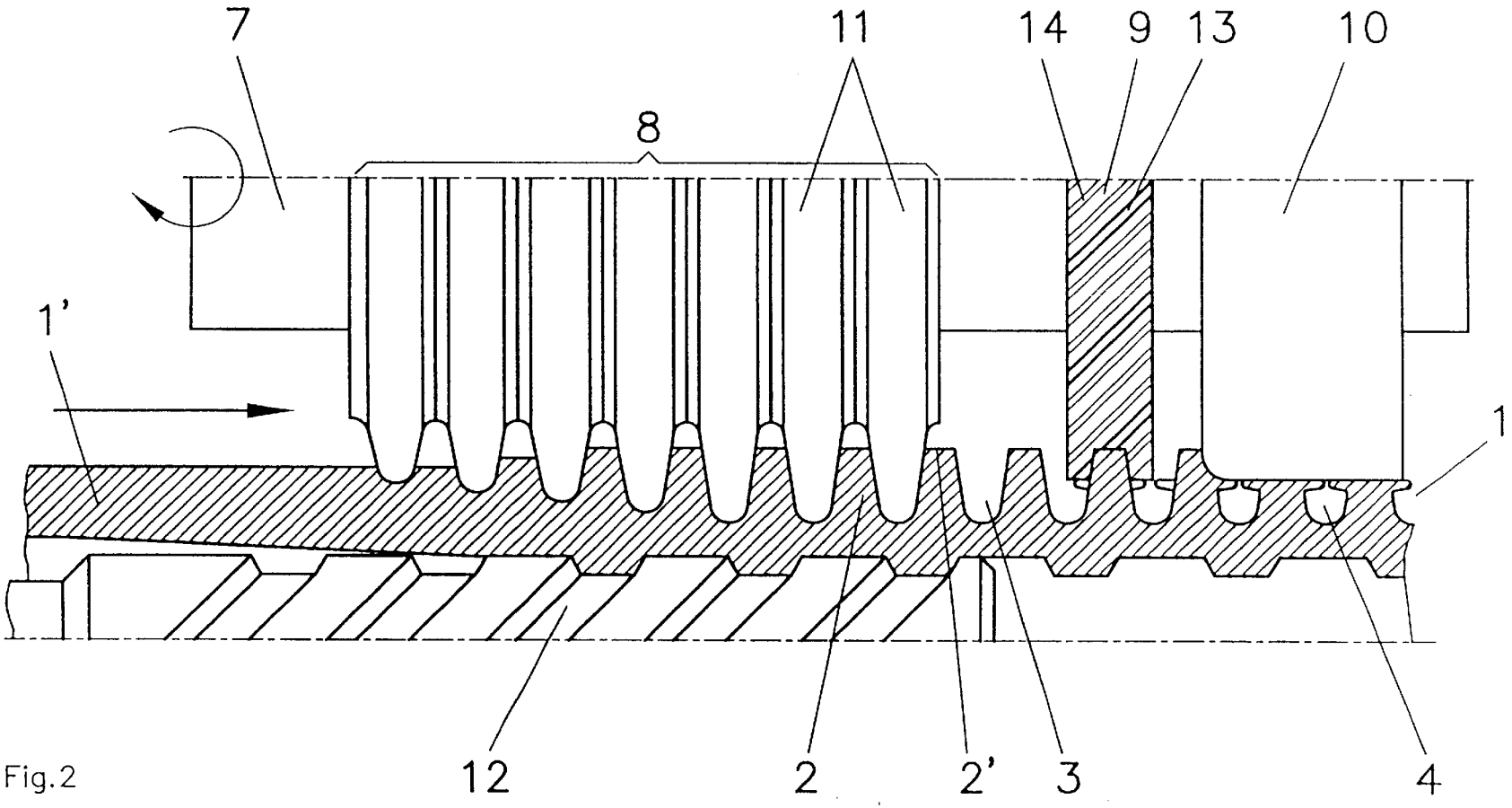
FIG. 2 illustrates an apparatus for the manufacture of the heat transfer tube.

The integrally finned tube 1 according to FIGS. 1 and 2 has helically circumferentially extending fins 2 on the outside, between which a groove 3 is formed. Material of the fin tips 2' is shifted in such a manner that the spaces between the fins are closed off but for large pores 5 (area A,) and small pores 6 (area $A_s$). Thus channels 4 between the fins 2 are formed. The channels 4 extend circumferentially with an essentially uniform cross section.

The finned tube 1 of the invention is manufactured by a finning process (compare U.S. Pat. Nos. 1,865,575/3,327,512) by means of the apparatus illustrated in FIG. 2.

An apparatus is utilized which consists of n=3 arbors 7, into each of which is integrated a rolling tool 8 and at least one following notching disk 9 and a flattening disk 10 (FIG. 2 shows only one arbor 7. However, it is possible to use, for example, four or more arbors 7). The arbors 7 are arranged offset each at $\alpha$=360°/n on the circumference of the finned tube wherein n=the number of arbors. The arbors 7 can be radially inwardly and outwardly adjusted. They are arranged in a stationary (not illustrated) milling head (according to another modification the tube with a rotating milling head is merely axially moved).

The plain tube 1', which moves into the apparatus in the direction of the arrow indicated in FIG. 2, is rotated by the rotating rolling tools 8 arranged on the circumference. The axes of the rolling tools 8 are skewed with respect to the axis of the tube. The rolling tools 8 consist in a conventional manner of several side-by-side arranged rolling disks 11, the diameter of which increases in the direction of the arrow. The rolling tools 8 shape the helically circumferentially extending fins 2 out of the tube wall of the plain tube 1'. The tube 1' is here supported by a mandrel 12.

Figure 3:
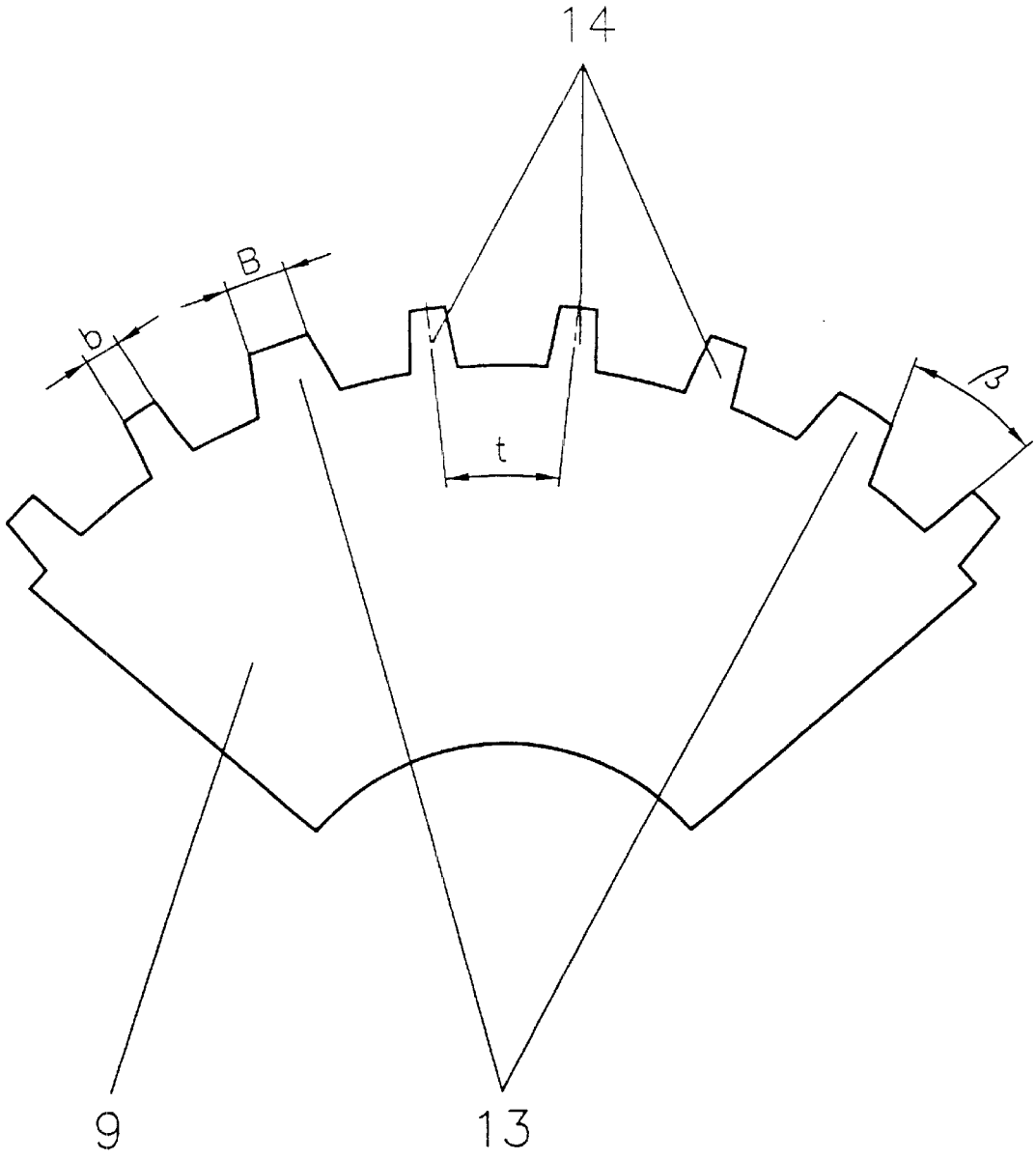
FIG. 3 illustrates a partial segment of a notching disk.

The fin tips 2' are notched by means of the notching disk 9, which has, according to FIG. 3, large and small teeth 13 and 14, respectively, distributed at regular intervals over the circumference. The notching disk 9 preferably has 8 to 25 teeth per centimeter of circumference.

The notched fin tips are subsequently flattened by the flattening disk 10, thus creating two pore classes, namely the large pores 5 and the small pores 6. The large pores 5 are thereby formed in the areas where the large teeth 13 of the notching disk 9 leave their imprint.

FIG. 3 indicates in addition the width b at the tip of the small teeth 14, the width B at the tip of the large teeth 13 and the flank angle $\beta$. The teeth ratio of B/b is 1.2 to 4, preferably 1.5 to 3.

If one brings the outside of the tube into contact with a liquid which is to be evaporated (FIG. 4), it is then achieved with the inventive design of the channels 4 and of the pores 5, 6 that the channel walls 15 are wetted by a liquid film 16. The phase change from liquid to vapor does then not occur through nucleate boiling but through thin film evaporation on the channel walls 15. The pore system has in this case to fulfill two different tasks. The liquid must initially be transported into the channels 4 lying under the outer tube surface. After evaporation the created vapor 17 must be able to escape to the outside.

In order to maintain the evaporation process, the same amounts of liquid and vapor 17 must be transported in opposite directions through the pores 5, 6. Otherwise the channels 4 are either flooded with liquid or they dry up. The evaporation process is strongly influenced in both cases or breaks down in the channels 4.

In order to be able to transport the produced vapor 17 (FIG. 4) out of the channels 4, a higher pressure must exist in the channels 4 than in the outer area. This excess pressure is adjusted by the superheat of the tube wall corresponding with the vapor pressure of the substance to be evaporated.

Usually liquids are used which wet the tube material well. Such a liquid can penetrate due to the capillary action through the pores 5, 6 in the outer tube surface against an excess pressure into the channels 4. A liquid meniscus is formed in each pore 5, 6, on the curved surface of which meniscus is created a discontinuity of the pressure due to the surface tension. This pressure difference is called the capillary pressure $\rho_c$, and is determined for spherically curved liquid surfaces by the following relation:

$$\rho_c = \frac{2 \cdot \sigma}{r}$$

In this equation is a the surface tension and r is the curvature radius of the meniscus surface. The curvature radius r depends on the contact angle $\theta$ and the pore shape. The following for pores 5, 6 having a circular cross section and pour radius R$\rho$ is valid:

$$\rho_c = \frac{2 \cdot \sigma \cdot \cos\theta}{R_p}$$

Figure 4:
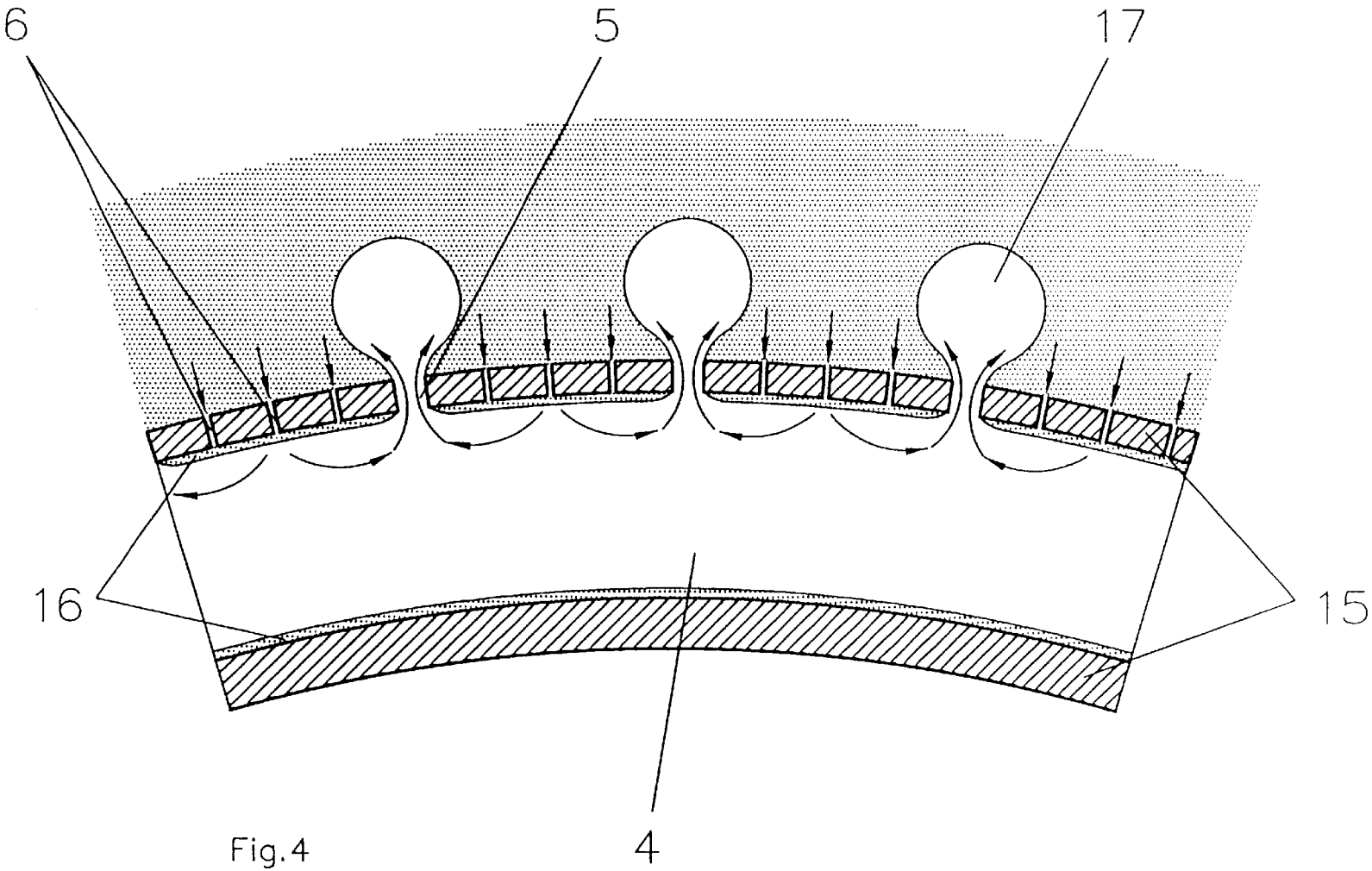
FIG. 4 illustrates schematically the oriented flow along a fin channel.

Similar relations can be derived for pores 5, 6 having a noncircular cross section. One recognizes that the greatest capillary pressure can occur at the pores 6 having the smallest radius. Thus the liquid penetrates through the small pores 6 into the channel 4, forms a thin film 16 on the channel walls 15 and evaporates upon the supply of heat. The vapor 17 escapes through the larger pores 5 since the capillary pressure is less at these pores. Thus a flow directed from the small pores 6 toward the large pores 5 is created. This is schematically illustrated in FIG. 4.

In order for sufficient liquid to be able to be carried into the channels 4, a sufficient number of as small as possible pores 6 must be available. At the same time the large pores 5 must be dimensioned in such a manner that the vapor 17 can escape sufficiently quickly and the channels 4 do not dry up. The size and number of the vapor pores 5 in relationship to the smaller liquid pores 6 are therefore extremely critical quantities.

It can be advantageous to utilize more than two classes of pores. The liquid penetrates hereby always through the pores of the smallest class into the channel, whereas the vapor escapes through the larger ones.

Numerical Example:

The influence of the design of the pore system on the efficiency of the tube 1, expressed by the heat transfer coefficient for shellside boiling in dependency of the heat flux, is illustrated using two differently designed pore systems.

The helically circumferentially extending channels 4 have a pitch of 0.5 mm and a height of a total of 0.75 mm. The outside diameter of the tube 1 is approximately 19 mm.

The geometric data of the utilized notching disks 9 are summarized in Table 1; a schematic illustration of such a notching disk 9 is illustrated in FIG. 3. The greater the width B at the tip of the large teeth 13, the greater is the pore area of the large pores 5.

TABLE 1

| No. | pitch of notches t | flank angle β | width b | width B | frequency ratio m |
|---|---|---|---|---|---|
| 1 | 0.50 mm | 25° | 0.20 | — | — |
| 2 | 0.50 mm | 25° | 0.20 | 0.40 | 8:1 |

Figure 6:
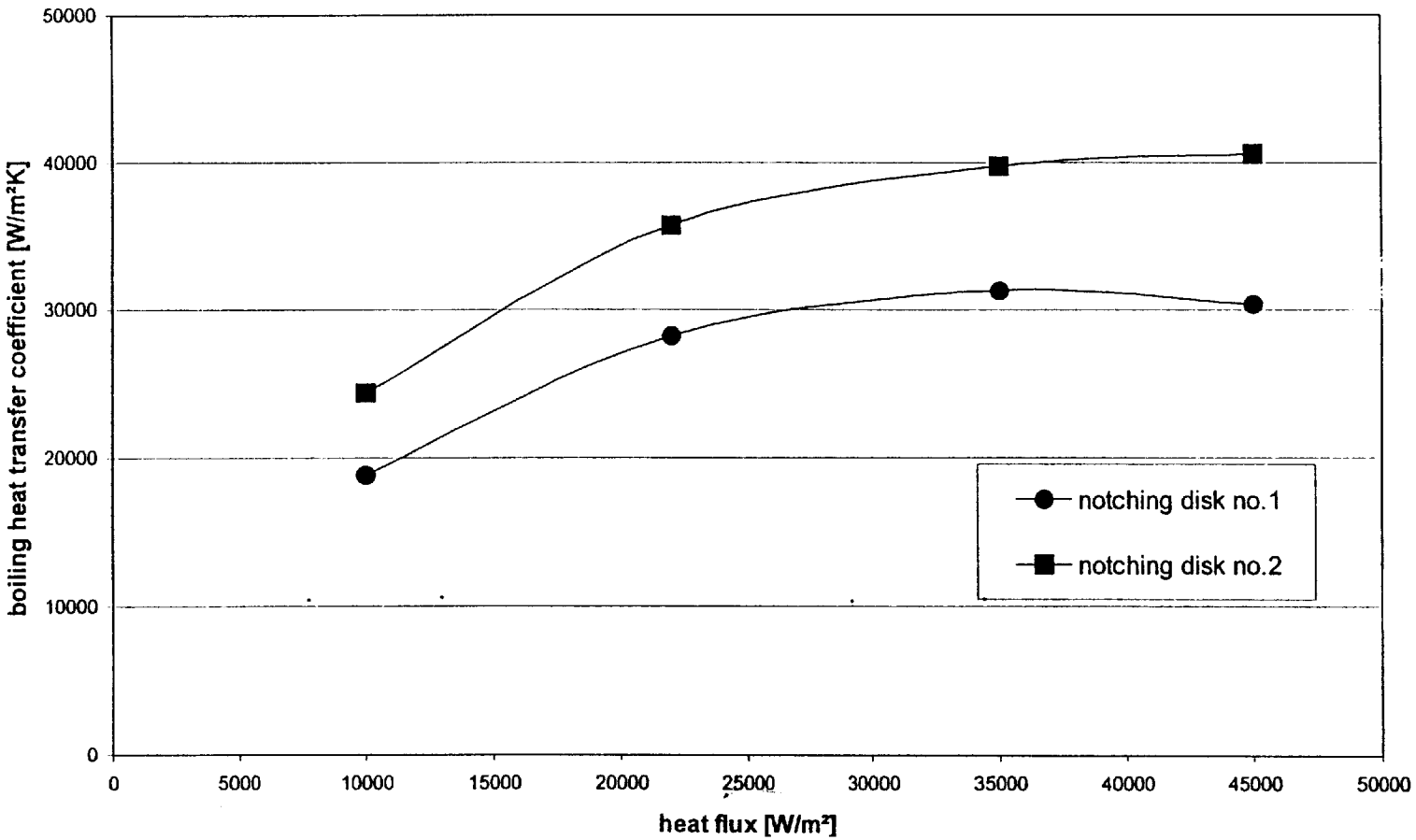
FIG. 6 illustrates the heat transfer coefficient for shellside boiling as a function of the heat flux for three differently designed pore systems.

The effect on the heat transfer coefficient for shellside boiling in dependency of the heat flux is exemplarily illustrated in FIG. 6 for the refrigerant HCFC 22 at 14.4° C. equilibrium temperature.

In comparison to a notching disk 9 having a constant tooth width (see No. 1), namely pores with the same size, one obtains in the case of the notching disk No. 2 an improvement of the heat transfer coefficient of approximately 30%.

Figure 5:
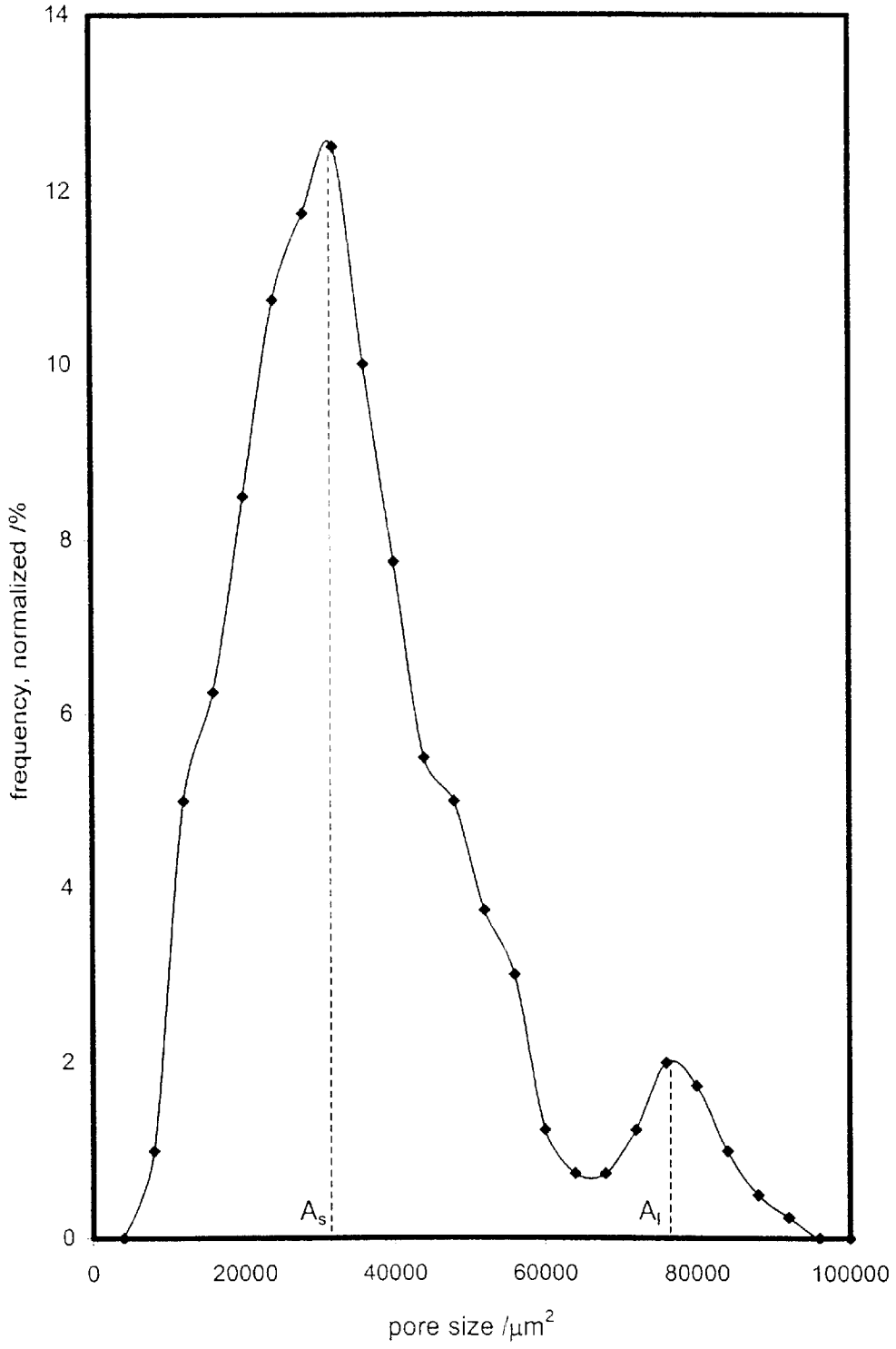
FIG. 5 illustrates as an example the frequency distribution of large and small pores.

FIG. 5 illustrate the frequency distribution of the pore size, which frequency distribution was based on the inventive tube sample. The class of the small pores 6 is grouped at a maximum at a pore area of approximately $A_s$=30000 $\mu m^2$, the class of the large pores 5 is grouped at a maximum at a pore area of approximately $A_l$=75000 $\mu m^2$.

If one further increases the size of the vapor pores 5, like in the case of the notching disk No. 3, then one obtains in comparison to the uniform pores a shellside heat transfer coefficient reduced by 25 to 45%. The vapor pores 5 are too large in this case, the channels 4 are flooded with liquid and the thin film evaporation collapses.

It is shown that the dimensions of the pores 5, 6 and the frequency of the larger vapor pores 5 have a significant influence on the operation and thus the performance of the structure.

The present observations show that the size of the channel is less significant and that the size of the pores are decisive for the operation and thus the heat transfer. Because of the missing widening of the channels (compare JP OS 63-172, 892, FIGS.5 and 7) adjacent channels are not negatively influenced.

U.S. Pat. No. 4,729, 155 relates to channels, which lie side-by-side, and which are connected by smaller cross-openings. The present invention relates, however, to closed-off channels in which an oriented flow exits as has been described above. Cross-connections between the channels result in a breakdown of the oriented flow and are therefore not usable for this concept.

What is claimed is:

1. A metallic heat transfer tube, in particular for the evaporation of liquids from pure substances or mixtures on the outside thereof, comprising integral fins which extend circumferentially annularly or helically on the outside and which are shaped to form essentially closed off channels, whereby the channels extend circumferentially with an essentially uniform cross section and are opened outwardly alternately through pores with at least two variable sizes comprising the following characteristics:

a) the reciprocal ratio between the average size $A_s$ of the smallest class of pores and the average size $A_l$ of the next larger class of pores is: $A_l/A_s$=1.5 to 4; and b) the frequency ratio m=number $N_s$ of pores of the smallest class of pores compared to the number $N_l$ of pores of the next larger class of pores is:

$$m = \frac{N_s}{N_l} = 12{:}1 \text{ to } 1{:}5.$$

2. The heat transfer tube according to claim 1, wherein the tube has two classes of pores.

3. The heat transfer tube according to claim 1, wherein $A_l/A_s$=2 to 3 and $$m = \frac{N_s}{N_l} = 9{:}1 \text{ to } 1{:}3.$$

4. The heat transfer tube according to claim 3, wherein the tube has two classes of pores.

5. The heat transfer tube according to claim 4, wherein the ratio between the entire open area $F_s$ of all small pores and the entire open area $F_l$ of all large pores is adjusted to the properties of the medium being used by:

$$\frac{F_s}{F_l} \sim \sqrt{\frac{\rho_V}{\rho_L}};$$

$$\text{with } \frac{F_s}{F_l} := \frac{\sum_i A_{s,i}}{\sum_j A_{l,j}} = \frac{A_s \cdot N_s}{A_l \cdot N_l} = \frac{A_s}{A_l} \cdot m$$

and $\rho_v$=density of the vapor and $\rho_L$=density of the liquid.

6. A method for the manufacture of a heat transfer tube with integral fins extending circumferentially helically on the outside thereof according to claim 1, in which the following method steps are carried out:

a) helically extending fins are formed out of the outer surface of a plain tube by obtaining the fin material through the displacement of material from the tube wall outwardly by means of a finning process, and the finned tube being created is rotated by the milling forces and/or is moved corresponding to the fins being created, whereby the fins with an increasing height are shaped out of the otherwise nonshaped plain tube, b) the tube is supported by a mandrel lying in said tube, c) after the fins have been shaped the tips of the fins are notched by a notching disk wherein:

c') the notching is caused by large and small teeth arranged on the circumference of the notching disk, d) the notched tips of the fins are flattened through radial pressure to the level of the notching.

7. An apparatus to carry out the method according to claim 6 wherein:

a) at least two radially adjustable arbors, which are offset with respect to one another and are arranged in a stationary milling head, are provided on the circumference of the finned tube, b) the arbors each have a rotating rolling tool with an axis skewed with respect to the tube axis, which rolling tool consists of several rolling disks, c) whereby the rolling disks have an increasing diameter, d) a notching disk is arranged after the rolling tool in at least one arbor wherein:

d') the notching disk has over its circumference in a regular arrangement large and small teeth, whereby in each case a specific number of small teeth is followed by a large tooth or several large teeth, and whereby the ratio between the number of small teeth and the number of large teeth is m=12:1 to 1:5, e) a flattening disk follows the notching disk.

8. The apparatus according to claim 7, wherein the ratio m=9:1 to 1:3.

9. The apparatus according to claim 7, wherein the notching disk has 8 to 25 teeth per cm of circumference.

10. The apparatus according to claim 7, wherein with a trapezoidal design of the teeth the ratio between the width B of the tip of one large tooth and the width b of the tip of a small tooth is B/b=1.2 to 4.

11. The apparatus according to claim 10, wherein the ratio is B/b=1.5 to 3.

12. The apparatus according to claim 7, wherein the notching disk is straight toothed.

13. The apparatus according to claim 7, wherein the notching disk is helically toothed.

* * * * *